United States Patent [19]

Bugai et al.

[11] Patent Number: 4,752,215

[45] Date of Patent: Jun. 21, 1988

[54] SPACE SAVER LOG PUSHER

[75] Inventors: John C. Bugai, Comstock Park; Charles B. Gentry, Belmont; Thomas W. Uganski, Jenison, all of Mich.

[73] Assignee: Granco-Clark, Inc., Belding, Mich.

[21] Appl. No.: 912,362

[22] Filed: Sep. 26, 1986

[51] Int. Cl.[4] ..... F27D 3/00

[52] U.S. Cl. ..... 432/5; 432/121; 414/198; 414/214

[58] Field of Search ..... 432/126, 143, 144, 153, 432/5, 9, 121; 198/617; 414/214, 160, 82, 14, 15, 16, 17, 18, 198, 196, 176; 219/10.69, 10.71

[56] References Cited

U.S. PATENT DOCUMENTS

| | | | |
|---|---|---|---|
| 1,127,315 | 2/1915 | Swindell | 414/198 |
| 1,828,762 | 10/1931 | Brosius | 414/214 X |
| 3,051,812 | 8/1962 | Gschwender | 219/10.69 |
| 3,127,035 | 3/1964 | Bourel | 414/214 X |
| 3,556,492 | 1/1968 | Hirata et al. | 198/617 |
| 4,444,538 | 4/1984 | Manley | 414/176 |
| 4,571,137 | 2/1986 | Malmgren | 414/173 |

FOREIGN PATENT DOCUMENTS

| | | | |
|---|---|---|---|
| 1149377 | 5/1963 | Fed. Rep. of Germany | 432/126 |

*Primary Examiner*—Harry B. Tanner

*Attorney, Agent, or Firm*—Varnum, Riddering, Schmidt & Howlett

[57] ABSTRACT

A method and apparatus for heating metal logs of a predetermined length in which the logs are cut into billets for an extrusion press. A furnace has an elongated heating chamber with an entrance opening and an exit opening. A pusher table is mounted adjacent the entrance opening of the furnace and a conveyor extends along the pusher table, through the entrance opening of the furnace, through the furnace heating chamber and through the exit opening thereof. A log dispenser is mounted adjacent the pusher table for dispensing logs seriatim onto the conveyor at the pusher table. An insert log has a length substantially less than the given length of the logs in the log train and is selectively positioned in the log train between the pusher and the lagging log in the log train to increase the effective length of the log train prior to adding a new log to the log train. As the log train is shortened sufficiently to add a regular log to the log train, the insert log is removed to allow positioning of the new log to the log train. The insert log provides a way for increasing the effective length of the log train to avoid double clutching without lengthening the pusher table.

25 Claims, 5 Drawing Sheets

18
16
82
20a
130
12
132
20
134
14
66
90
68

SPACE SAVER LOG PUSHER

BACKGROUND OF THE INVENTION

1. Field of the Invention

This invention relates to feeding metal logs to a heating furnace. In one of its aspects, the invention relates to a method of heating metal logs to an elevated temperature wherein the logs are fed seriatim to an elongated heating zone. In another of its aspects, the invention relates to an apparatus for heating metal logs in an elongated heating furnace wherein the logs are pushed seriatim end to end into a heating furnace. In still another of its aspects, the invention relates to an apparatus for feeding metal logs to an elongated heating furnace.

2. State of the Prior Art

In aluminum extrusion plants, aluminum billets are heated to an elevated temperature and are extruded into formed shapes. The billets are generally of a size selected to produce the shapes of a given length. Thus, in order to minimize scrap, the size of the billet is selected to meet the needs of the shape and length of the extruded products. For this purpose, billets of different sizes and different compositions may be needed.

It has become the practice in such extrusion plants to inventory logs of approximately 12–20 feet, to heat the logs to an elevated temperature and to cut the logs to a predetermined size just prior to the use of billets in the extrusion press. One type of furnace used to heat logs to elevated temperature has an elongated heating chamber with an entrance opening and an exit opening at opposite ends. A pusher table is positioned adjacent the entrance opening of the furnace and a conveyor, usually a roller conveyor, extends along the pusher table, through the entrance end of the furnace and through the exit end of the furnace. A log dispenser is positioned adjacent the pusher table for dispensing logs seriatim onto the conveyor at the pusher table. A pusher mechanism is mounted for movement along the conveyor between opposite ends of the pusher table to push the logs along the conveyor in a log train into and through the furnace. The log train has a leading log on the conveyor at an exit opening in the furnace and a lagging log which may be partially or wholly supported by the conveyor at the pusher table. A shear press is positioned adjacent the exit opening of the furnace for cutting the logs into billets.

When a billet is required at the shear press, the pusher pushes on the lagging end of the lagging log to push the leading log out of the exit end of the furnace and pass the shear press a distance equal to the desired size of the billet. The shear press is operated to cut the billet to a particular length. The billet is removed and sent to the extrusion press. A reverse pusher then pushes the leading log back into the furnace for continued heating. Thus, the log train reciprocates back and forth in the furnace and into and out of both the entrance opening and exit opening of the furnace.

In this process, there comes a time when the pusher on the pusher table reaches the end of its track at the entrance opening of the furnace. If this point is reached when the log train is being pushed to the shear press, the pusher mechanism must stop and retract, allow a second log to be positioned on the conveyor and then continue the pushing operation until the leading log reaches the proper position at the shear press. This operation is known as "double clutching." The double clutching operation results in a slowdown in the extrusion cycle since some appreciable time expires between the time the pusher can retract to an opposite end of the pusher table and a new log can be dispensed and brought up to the log train. All of the extrusion equipment and runout equipment is waiting while this double clutching operation takes place. This operation decreases the efficiency of an extrusion plant.

In order to overcome this problem, the pusher table length has been extended and the log-dispensing mechanism has been spaced a farther distance from the entrance opening of the furnace. Typically, the distance between the entrance opening of the furnace and the leading edge of the logs in the log dispenser is equal to the maximum cut length of the billet, plus the distance from the shear press to the shear line, plus the distance from the furnace entrance and to the maximum forward position of the pusher and plus a small tolerance. This distance is perhaps 5–6 feet. With this construction, a new log can be added to the log train during the period of time that the leading log has been returned to the furnace without interfering with the pusher mechanism. When the pusher reaches a predetermined position close to the furnace during a billet-shearing interval, the pusher mechanism can be retracted and a new log added to the pusher table conveyor without interfering with the lagging log in the log train.

The problem with the spacing solution is that it adds 5–6 feet to the length of the furnace equipment. Plant space is costly and thus the equipment adds additional cost on an ongoing basis to the plant operation. However, in some case, there is simply not enough room in the plant to put in this additional-length equipment.

SUMMARY OF THE INVENTION

According to the invention, there is provided a method and apparatus for heating metal logs of a predetermined length to an elevated temperature without the necessity of using the double clutching technique and without the requirement for an extended length on the pusher table. The method according to the invention comprises the steps of positioning a plurality of logs in a sequential log train in a heating zone with a leading log wholly within a heating zone at an exit end thereof and a lagging log in the log train extending at least partially out of the entrance end of the heating zone, advancing the leading log in the log train to a shear press outside the heating zone by pushing the lagging log in the log train toward the exit end of the furnace, severing a leading portion of the leading log in the log train, returning the remaining portion of the leading log to the heating zone and periodically adding a new log to the lagging end of the log train to form a new lagging log in the log train. The invention comprises the steps of adding an insert log, shorter than the predetermined length of the logs, to the end of the log train prior to the step of adding a new log to the lagging end of the log train, whereby the insert log temporarily forms a lagging log in the log train and repeating the steps of advancing the leading log, severing a leading portion of the leading log in the log train and returning the remaining portion of the leading log to the heating zone at least once with the insert log forming the lagging log in the log train, and further removing the insert log from the log train. The method provides for minimizing the spacing between a source of the logs and the entrance end of the heating zone.

Preferably, the step of adding an insert log takes place prior to the step of returning the remaining portion of the leading log to the heating zone. Typically, the steps of advancing the leading log, severing the leading portion of the leading log and returning the remaining portion of the leading log are repeated until the lagging end of the lagging log reaches a predetermined distance from the entrance end of the furnace. Further, this process is continued until the lagging end of the insert log reaches a predetermined distance from the entrance end of the heating zone after the step of inserting the insert log into the log train.

Further according to the invention, there is provided an apparatus for heating elongated metal logs of a given length and diameter to an elevated temperature in an apparatus wherein a furnace has an elongated heating chamber with an entrance opening and an exit opening, a pusher table is adjacent the entrance opening of the furnace, conveyor means extends along the pusher table through the entrance opening of the furnace, through the furnace heating chamber and through the exit opening thereof, a log dispenser means is positioned adjacent the pusher table for dispensing logs seriatim onto the conveyor at the pusher table and a pusher means is mounted for movement along the conveyor between opposite ends of the pusher table to push logs along the conveyor in a log train into and through the furnace. The log train has a leading log on the conveyor at the exit opening of the furnace and a lagging log at least partially supported by the conveyor at the pusher table. The invention provides an insert log having a length substantially less than the given length of the logs and a means for selectively positioning the insert log in the log train between the pusher and the lagging log to increase the effective length of the log train prior to adding a new log to the log train. The selective positioning means further comprises means for selectively removing the insert log from the log train before adding a new log to the log train.

Preferably, the insert log and the pusher means have releasable interengaging means to pull the insert log back from the furnace entrance opening with the pusher means for removing the insert log from the log train. The interengaging means preferably comprises an inverted U-shaped member having a slotted leg on the pusher means and a headed pin extending axially from the end of the insert log. The pin is received within the slotted leg and a head on the headed pin is received within the legs of the inverted U-shaped member.

The selective positioning means preferably comprises means for mounting the insert log for selective movement between a position axially adjacent the conveyor and a position axially aligned with the conveyor. In a preferred embodiment of the invention, the position axially adjacent the conveyor is beneath the conveyor and is positioned at an end of the pusher table distal from the entrance end of the furnace.

The invention is used in an apparatus which further comprises a shear press positioned a spaced distance from the exit opening of the furnace and aligned therewith for cutting billets of a given length from the leading log in the log train. The insert log has a length at least equal to the spaced distance between the shear press and the exit opening of the furnace and the given length of the billets. In this arrangement, a second pusher is mounted adjacent to the shear press and aligned with the log train for pushing the log train toward the pusher table to return the leading log to the furnace after cutting a billet therefrom. In a preferred embodiment of the invention, the insert log has a diameter substantially equal to the diameter of the metal log.

Further according to the invention, there is provided an apparatus for feeding elongated metal logs of a given length to a furnace having an elongated heating chamber with an entrance opening and an exit opening at opposite ends thereof. A pusher table is adapted to be mounted adjacent the entrance opening of a furnace chamber. Conveyor means extend along the pusher table for registry with the entrance opening of the furnace chamber and adapted to receive logs from a log dispenser adjacent the conveyor means. A pusher is mounted for movement along the conveyor means between opposite ends of the pusher table to push a lagging log on the conveyor means is a train of said logs into the entrance opening of the furnace chamber. According to the invention, an insert log having a length substantially less than the given length of the logs is provided. Means for selectively positioning the insert logs on the conveyor means between the pusher means and the lagging log on the conveyor is provided to increase the effective length between the pusher means and a lagging end of the lagging log on the conveyor prior to adding another log to the conveyor means. Means are further provided for selectively removing the insert log from the conveyor before a new log is added to the log train.

BRIEF DESCRIPTION OF THE DRAWINGS

The invention will now be described with reference to the accompanying drawings in which.

Figure 1:
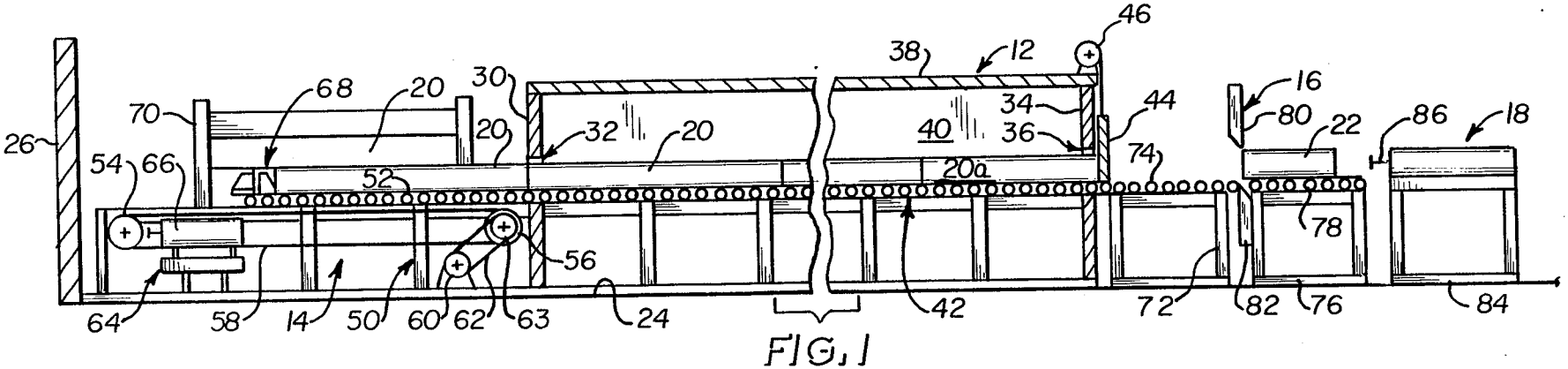
FIG. 1 is a side elevational view in schematic form of a log pusher apparatus according to the invention along with a log heating furnace, a shear press and a log return apparatus.

Referring now to the drawings, and to FIG. 1 in particular, there is shown an elongated heating furnace 12 having a pusher table 14 at the entrance end of the furnace and a shear press 16 at the exit end of the furnace. A push-back cylinder 18 is provided in spaced relationship to the shear press 16. Metal logs 20 extend from the pusher table 14 through the elongated heating furnace 12, with a lead metal log 20a provided at the exit end of the furnace. A floor 24, for example of a plant, supports the furnace, pusher table, shear press and push-back cylinder. A wall 26, for example of the building, is shown adjacent to the pusher table 14.

The furnace 12 has a front wall 30 with an entrance opening 32, a back wall 34 with an exit opening 36, a roof 38 and side walls 40, all of which are joined together to make an enclosure. Furnaces of this nature are well known and typically comprise heating elements (not shown) to direct combustion gases directly against the logs 20 in the furnace to heat them to a predetermined temperature suitable for use in an extrusion press. A roller conveyor 42 is provided within the furnace to support the logs. The roller conveyors are also conventional and well known. A door 44 is supported for vertical movement, for example, on a pulley 46 in front of the exit opening 36.

The pusher table 14 comprises a support table 50 having a conventional roller conveyor 52 mounted thereto. Pairs of sprockets 54 and 56 are mounted at either end of the support table 50 and drive chains 58, one on each side of the table 14. A reversing motor 60 drives the sprockets 56 through a chain 62 and a drive sprocket 63. An insert lift 64 is positioned at the left or leading end of the support table 50 and an insert log 66 is mounted on the insert lift. A pusher head 68 is mounted for sliding along the top of the support table 50 and is driven by the chains 58 to move from a position at the extreme left end of the support table 50 to a position at the extreme right end of the support table 50. Thus, the motor 60 drives the pusher head 68 through a movement from one end of the support table 50 to the other and vice versa.

A log dispenser 70 is provided adjacent to the pusher table 14 to dispense logs 20 as desired onto the pusher table 14. The log dispenser is shown in schematic form and is well known in the log-heating industry.

A table 72 having a roller conveyor 74 is positioned adjacent the exit-end opening 36 of the furnace 12 to convey a log to a table 76 having a roller conveyor 78.

The shear press 16 comprises an upper shear blade 80 and a lower shear blade 82. The mechanism for driving these two blades together is not shown. Shear equipment for severing metal logs is well known in the aluminum extrusion industry, for example.

The push-back cylinder 18 is supported on a table support 84. The cylinder 18 is a conventional pneumatic or hydraulic cylinder which has pusher rod 86 adapted to extend from the position illustrated in FIG. 1 to an extended position to push the logs back into the furnace after a billet 22 has been severed from a log. In FIG. 1, a billet 22 is shown on the table 76 after having been severed from the lead log 20a. Typically, the billet 22 will be transferred immediately to an extrusion press wherein the billets will be extruded into a given shape.

Figure 2:
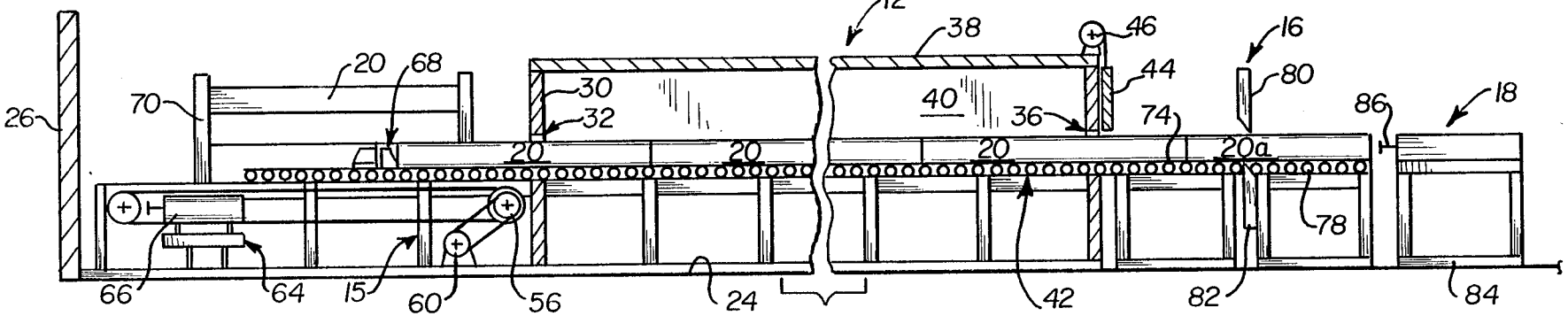
FIG. 2 is a view like FIG. 1 showing a log in position at the shear press for shearing into a billet.

FIG. 2 shows the method by which the logs are moved to the shear press for cutting into billets. First, the door 44 is raised to open the exit opening 36 of the furnace. The motor 60 then drives the sprocket 56 to thereby drive the chain 58 to move the pusher head 68 to the right. In this manner, the entire log train of logs 20 and 20a is shifted to the right to the position illustrated in FIG. 2. The motor 60 drives the pusher head 68 a predetermined distance which corresponds to the desired length of the billet to be cut plus the distance from the shear press 16 to the position of the log 20a in the end of the furnace. When the pusher head 68 has moved the predetermined distance, the motor 60 will stop and the shear press 16 will be activated to force the shear blades 80 and 82 together to thereby sever a billet from the lead log 20a. The motor 60 then reverses direction to drive the sprocket 56 and chain 58 to reverse the direction of the pusher head 68 a distance equal to the distance between the sheared end of the lead log 20a and a point just inside the exit end 36 of the furnace 12. The push-back cylinder 18 will then be actuated to extend the pusher rod 86 to push the entire log train to the left as illustrated in FIG. 2 to return the lead log 20a to the position illustrated in FIG. 1.

After each push back of the logs, the pusher head 68 moves in increments down toward the entrance end of the furnace. At some point, the pusher head cannot move any farther along the chain and a new log 20 must be added to the log train. If the sprocket 56 is directly adjacent the entrance end of the furnace, the pusher head 68 will be able to move up to that point. If that point is reached before the leading log 20a has reached the proper position with respect to the shear press 16, it will be necessary to stop the pushing operation, retract the pusher head 68 to the sprocket 54, dispense a new log 20 onto the pusher table and then continue the pushing process until the feed log 20a reaches the proper position. This operation, known as double-clutching, takes a certain amount of time. Because the pushing operation does not commence until a billet is called for, the double-clutching operation interrupts the production cycle. This interruption can have a significant deleterious effect on the production efficiency of a plant.

In order to overcome this "double-clutching" problem, it has been conventional to space the leading end of the log dispenser 70 a sufficient distance from the entrance end of the furnace so that a new log can be added to the log train before the problem occurs. Typically, this spacing is equal to the maximum cut length for a billet, plus the distance from the shear to the leading end of the billet 20a in the furnace as illustrated in FIG. 1 plus the distance from the leading end of the pusher to the furnace opening and plus a tolerance between the back end of the log train and the leading end of a new log which will be dispensed. This spacing, typically about 8–10 feet, eliminates the double-clutching problem and maintains production efficiencies. The trade-off, of course, is the factory space which must be provided. In addition to the ongoing expense of factory space, occasionally there is not enough room for the long line of equipment and the spacing simply cannot be provided. As illustrated in FIGS. 1 and 2, a wall 26 may preclude the ability to provide the appropriate spacing to prevent double-clutching.

The invention seeks to overcome these problems by providing an insert log 66 at selective times in the log train to enable the pusher to push the leading log 20a to the maximum cut position without having to double-clutch and without requiring the extra spacing between the log dispenser 70 and the entrance end of the furnace 12.

Referring now to FIG. 3–6, the insert lift 64 will be described in more detail. A pair of cylinders 90 are mounted vertically on a base and are connected to an elongated rectangular frame 94 through cylinder rods 93 and couplers 92. The frame 94 mounts a pair of V-track wheels 96 at either end thereof and mounts a cradle 98 above the frame 94 through a pair of vertical supports 100. A pair of horizontal frame members 102 are mounted to the table frame and support vertical V-tracks 104 in registry with the V-track wheels 96.

The insert log 66 comprises an elongated body 108 of a shape similar to the shape of the logs but significantly shorter. For example, whereas the logs may be 18 feet long, the insert log may be in the order of 4 feet. The length of the log is selected with respect to the furnace to avoid double-clutching. In other words, the insert log length would be at least equal to the maximum cut length for the billet plus the distance between the shear and the entrance end of the furnace plus the distance between the furnace entrance and the pusher head 68 at its closest position to the furnace plus the tolerances at the end of the log column to the log dispenser. A circular head 110 is mounted to the back end of the elongated body 108 through a pin 112.

Figure 6:
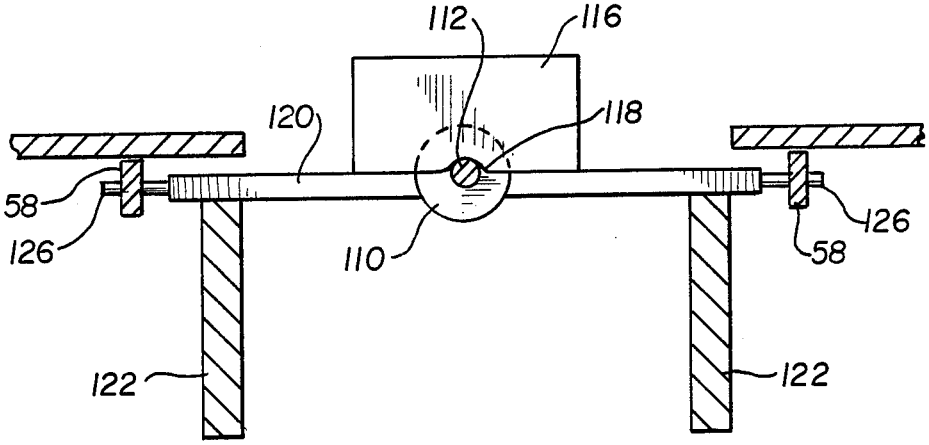
FIG. 6 is a partial sectional view taken along lines 6—6 of FIG. 5.

The pusher head 68 comprises a U-shaped pusher 116 with a downwardly-opening slot 118 at an outer leg thereof. The U-shaped pusher 116 is mounted on a slide plate 120 and, as seen in FIG. 6, rests on mounting plates 122. The rollers of roller conveyor 52 are supported by the mounting plates 122 through pins (not shown) in conventional fashion. The slide plate 120 in turn is mounted to the chains 58 through pins 126. As shown in FIG. 6, the chains 58 are positioned at both sides of the roller conveyor 52.

Figure 3:
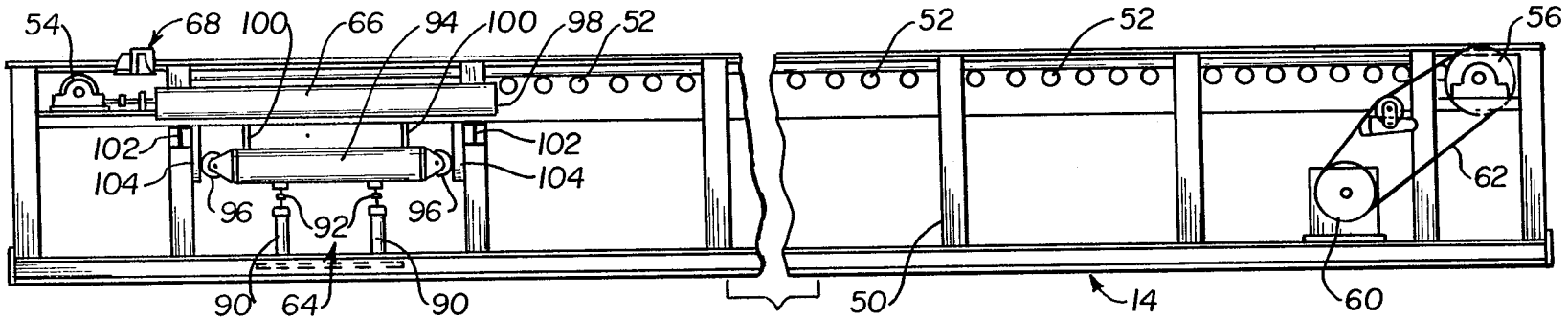
FIG. 3 is an enlarged view of the log pusher apparatus shown in FIG. 1.
Figure 4:
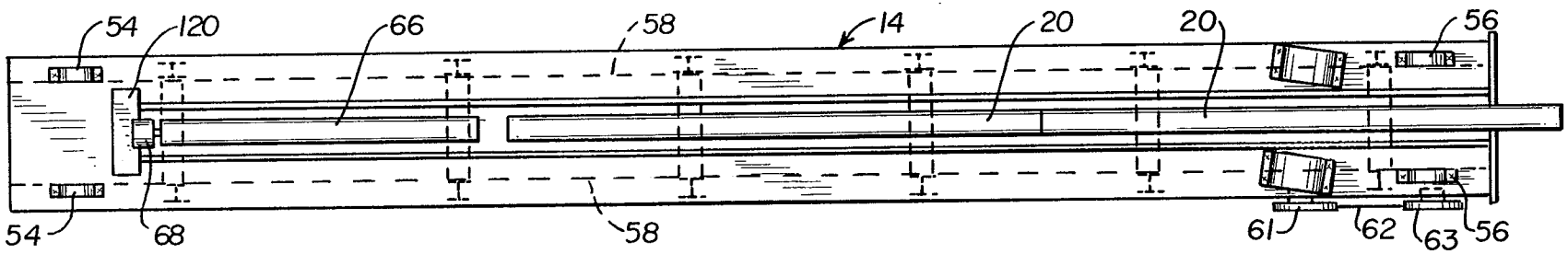
FIG. 4 is a plan view of the log pusher apparatus shown in FIG. 3.
Figure 5:
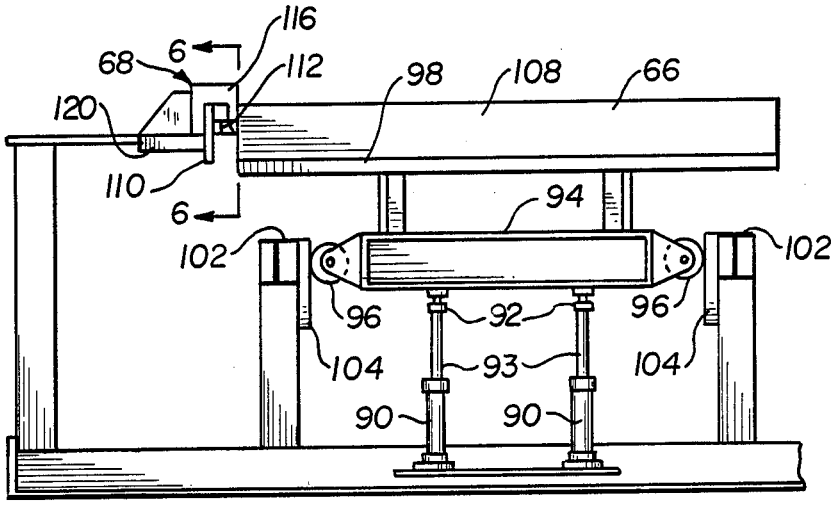
FIG. 5 is an enlarged side elevational view of a portion of the log pusher apparatus shown in FIG. 3.

The operation of the insert log will be described with respect to FIGS. 3, 5 and 6. The insert log is ordinarily in the position illustrated in FIG. 3, that is, slightly below the roller conveyor 52, during the normal operation when the pusher head is positioned against the back end of the end log 20 in the log train as has been described, for example, with respect to FIG. 1 and 2 above. The insert log 66 is thus beneath the path of the pusher head 68 and beneath the position of any logs 20 which may be in the log train. When the pusher head, however, gets to a predetermined position near the entrance end of the furnace after a billet has been cut from the lead log 20*a*, the pusher head 68 returns to the position illustrated in FIG. 3, that is nearest the sprocket 54. In this position, the U-shaped pusher element 116 is directly over the circular head 110 so that the opening between the legs of the U-shaped pusher element 116 is vertically aligned with the circular head 110. The cylinders 90 are then actuated to raise the frame 94 with the V-track wheels 96 being guided along the vertical V-tracks 104. The frame 94 is raised until it reaches the position illustrated in FIG. 5 wherein the insert log 66 is directly aligned with the roller conveyor 52 and the logs 20 in the log train. As the frame 94 is raised, the circular head 110 of the insert log 66 is received between the legs of the U-shaped pusher element 116, and the pin 112 is received in the slot 118 of the leg of the U-shaped pusher element 116. The motor 60 is then driven to drive the pusher head 68 to the right as illustrated in FIG. 3 and thereby bring the leading edge of the insert log 66 into contact with the lagging end of the last log 20 in the log train. The reciprocatory movement of the log train, as described above with respect to FIGS. 1 and 2, then continues until the pusher head 68 gets near the entrance end of the furnace after it has pushed the log train to the position illustrated in FIG. 2. The motor 60 will then be reversed to drive the pusher head 68 back to the position illustrated in FIG. 3, near the sprocket 54. Because of the receipt of the circular head 110 within the U-shaped pusher 116, the backward movement of the pusher head 68 will drag with it the insert log 66. In this position, the insert log 66 will once again rest on the cradle 98. The cylinders 90 will then be actuated to retract the cylinder rods 98 and thereby lower the frame 94, the cradle 98 and the insert log 66 back to the position illustrated in FIG. 3. As this operation takes place, the pin 112 and the circular head 110 will be disengaged from the U-shaped pusher element 116. The log dispenser 70 will then be actuated to dispense another 20 onto the pusher table 14. The motor 60 will then be energized to drive the pusher head 68 forwardly, or to the right as illustrated in FIG. 3, until the new log contacts the last log in the log train. The operation will then continue as described in FIGS. 1 and 2.

Figures 7, 8, 9, 10:
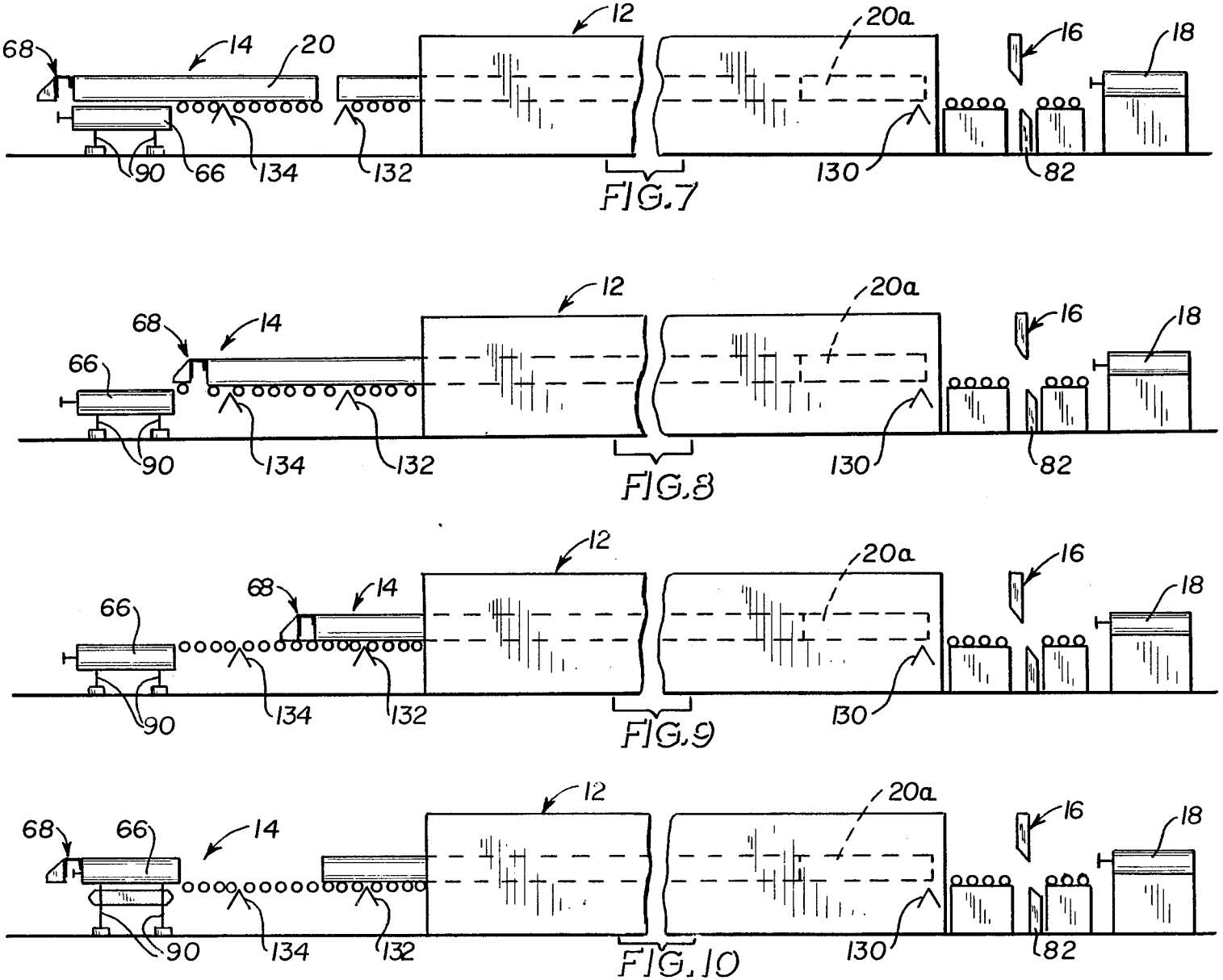
FIG. 7 is a schematic view of the apparatus shown in FIG. 1 and illustrating a first step in a sequence of heating and cutting logs into billets according to the invention.
FIG. 8 is a view like FIG. 7 showing a second step in the log heating and cutting sequence.
FIG. 9 is a view like FIG. 7 showing a third step in the log heating and cutting sequence.
FIG. 10 is a view like FIG. 7 showing a fourth step in the log heating and cutting sequence.
Figure 11:
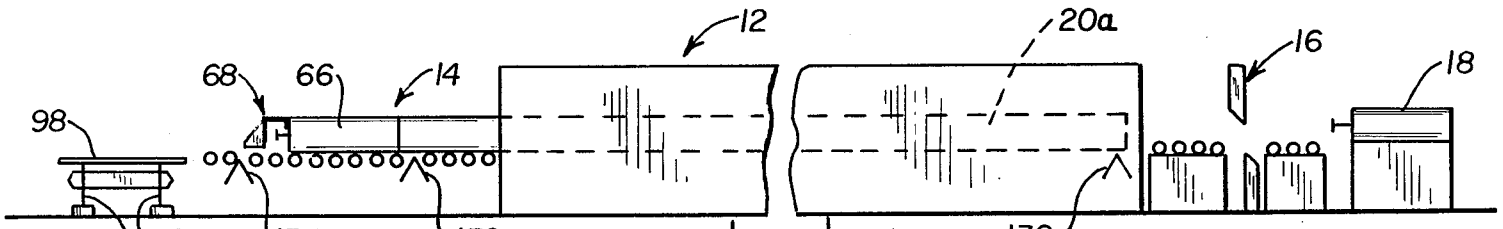
FIG. 11 is a view like FIG. 7 showing a fifth step in the log heating and cutting sequence.

The operation of the invention will now be described further with reference to FIGS. 7–13. Referring specifically to FIG. 7, the heating furnace 12, the pusher table 14 along with the insert log 66, the shear press 16, the push-back cylinder 18 and the metal logs 20 are shown in schematic form. Further, a limit switch 1 (130) is shown just inside the exit opening 36 of the furnace, a limit switch 2 (132) is shown spaced a short distance outside the entrance opening 32 of the furnace and a limit switch 3 (134) is shown spaced further distance from the entrance end of the furnace. The limit switches 130, 132 and 134 can be conventional electro-mechanical switches or can be photosensors which sense the presence or absence of a log in the log train. The limit switch 1 (130) is positioned so as to detect the position of the leading log 20*a* or the absence of the leading log 20*a* when the leading log 20*a* is in the position illustrated in FIGS. 1 and 7, i.e. completely within the furnace. The limit switch 2 (132) is positioned so as to detect the presence of a log or the pusher head 68 when the pusher head is at or close to the maximum forward travel, i.e. at sprocket 56. The distance between the limit switch 2 (132) and limit switch 3 (134) is essentially the length of the insert log 66. The insert log has a length as set forth above to make sure that the operation can continue to cut a maximum billet length before a new log needs to be dispensed.

As a new log is added to the log train, as represented in FIG. 7, the limit switch 1 (130) will detect no log, and the limit switches 2 and 3 will both detect the presence of a new log. The reciprocatory movement of the log train and the shearing operation as described above with respect to FIGS. 1 and 2 continue with the pusher head 68 moving forward incrementally toward the furnace entrance end as illustrated in FIG. 8. So long as the limit switches 2 (132) and 3 (134) show the presence of a log and the limit switch 1 shows no log, a new log will not be loaded onto the pusher table. This condition is illustrated in FIG. 8. The pusher head 68 is ready for the next push of the log train to the shear press. Further, so long as the limit switch 1 (130) shows the presence of a log, that is, when the log train is in the extended position as illustrated in FIG. 2, no new log will be dispensed from the log dispenser 70.

Figure 12:
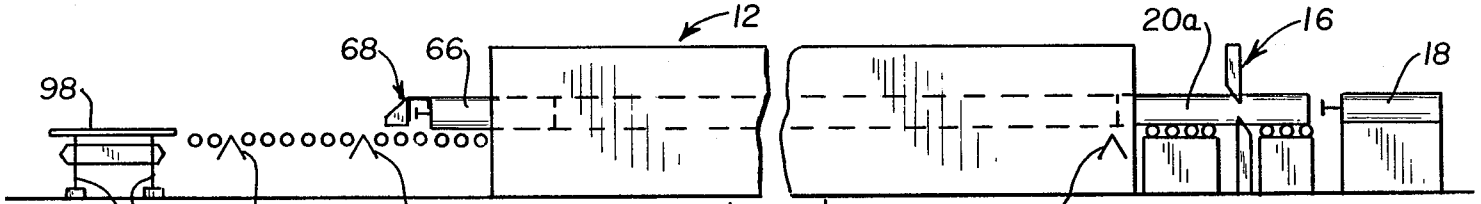
FIG. 12 is a view like FIG. 7 showing a sixth step in the log heating and cutting sequence.
Figure 13:
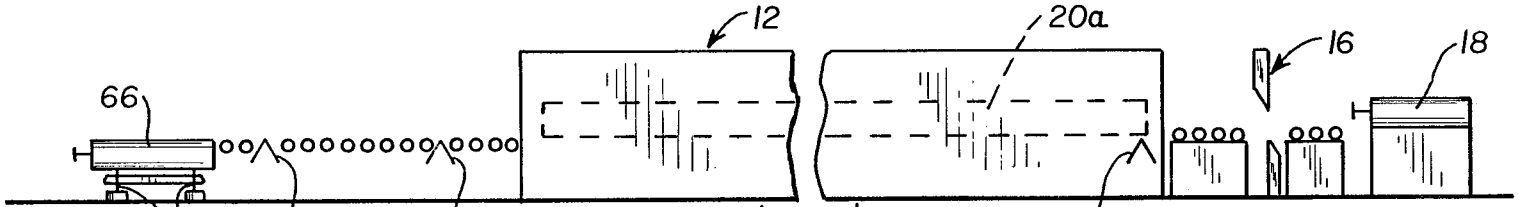
FIG. 13 is a view like FIG. 7 showing a seventh step in the log heating and cutting sequence.

The operation of cutting billets as described above continues until the pusher head 68 reaches a position between limit switches 2 (132) and 3 (134) when the log train is in the retracted position as illustrated in FIG. 9. At this point, the motor 62 is energized to return the pusher head 68 to the back end of the pusher table 14 as illustrated in FIG. 10. The insert lift 64 is actuated to raise the insert log 66 into registry with the log train. This condition is illustrated in FIG. 10. When another billet is called for, the motor 60 will be driven to drive the pusher head 68 forwardly, that is to the right as illustrated in FIG. 10, until the leading log 20*a* reaches the appropriate position for severing a billet. After the billet is severed, the push-back cylinder 18 pushes the remaining portion of the leading log 20*a* back into the furnace whereby the insert log 66 and the pusher head 68 will assume the position illustrated in FIG. 11. The limit switch 3 (134) and the limit switch 1 (130) will show no log whereas the limit switch 2 (132) will show the presence of a log. The reciprocatory movement of the log train and the cutting of billets continue to the point where the pusher head 68 is further to the right than limit switch 2 (132) when the logs have been returned to the furnace as illustrated in FIG. 12. When this condition occurs, the motor 60 will be driven to move the pusher head 68, and thus the insert log 66 back to the initial or start position, at which point, the insert lift 64 will be actuated to lower the insert log out of registry with the logs 20 in the log train. A new log 20 will then be dispensed from the dispenser 70 and the cycle will begin anew.

The operation described above can be manually controlled by an operator, or can be controlled automatically by an electric control system which can be either handwired or programmed. Such automatic control systems are known to those skilled in the art of control systems.

The invention thus provides a mechanism for the continuous operation of supplying logs to a shear press from a log heating furnace without interruption for double-clutching and using a minimum of plant space. The invention thus avoids delays in production while reducing the factory space heretofore required when maximum production was achieved in reciprocatory log heating furnaces.

Reasonable variation and modification are possible within the scope of the foregoing disclosure and drawings without departing from the spirit of the invention.

The embodiments of the invention in which an exclusive property or privilege is claimed are defined as follows:

1. In a method for heating metal logs of a predetermine length to an elevated temperature comprising the steps of:

(a) positioning a plurality of logs in a sequential log train in a heating zone with a leading log wholly within a heating zone at an exit end thereof, and a lagging log in the log train extending at least partially out of an entrance end of the heating zone;

(b) advancing the leading log in the log train to a shear press outside the heating zone by pushing the lagging log in the log train toward the exit end of the furnace;

(c) severing a leading portion from the leading log in the log train;

(d) returning the remaining portion of the leading log to the heating zone; and (e) periodically adding a new log to the lagging end of the log train to form a new lagging log in the log train;

the improvement which comprises:

(f) adding an insert log, shorter than the pre-determined length, to the end of the log train prior to step (e), whereby said insert log temporarily forms the lagging log of said log train;

(g) repeating steps (b)–(d) at least once with the insert log forming the lagging log in the log train; and (h) removing the insert log from the log train, whereby the spacing between a source of the logs and the entrance end of the heating zone can be minimized.

2. A method for heating metal logs according to claim 1 wherein step (f) takes place prior to step (d).

3. A method for heating metal logs according to claim 1 wherein steps (b)–(d) are repeated until the lagging end of the lagging log reaches a predetermined distance from the entrance end of the heating zone.

4. A method according to claim 3 wherein step (g) is repeated until the lagging end of the insert log reaches a predetermined distance from the entrance end of the heating zone.

5. A method of heating metal logs according to claim 1 wherein step (g) is repeated until a lagging end of the insert log reaches a predetermined distance from the entrance end of the heating zone.

6. In an apparatus for heating elongated metal logs of a given length and diameter to an elevated temperature, said apparatus comprising:

a furnace having an elongated heating chamber with an entrance opening and an exit opening;

a pusher table adjacent the entrance opening of said furnace;

conveyor means extending along said pusher table through the entrance opening of said furnace, through said furnace heating chamber and through said exit opening thereof;

a log dispenser means adjacent said pusher table for dispensing said logs seriatim onto said conveyor at said pusher table;

pusher means mounted for movement along said conveyor means between opposite ends of said pusher table to push logs along said conveyor means in a log train into and through said furnace, said log train having a leading log on said conveyor means at said exit opening of said furnace and a lagging log at least partially supported by said conveyor means at said pusher table;

the improvement which comprises:

insert log means having a length substantially less than said given length of said logs; and means for selectively positioning said insert log means in said log train between said pusher means and said lagging log to increase the effective length of said log train prior to adding a new log to said log train.

7. An apparatus for heating elongated metal logs according to claim 6 and further comprising means for selectively removing said insert log means from said log train before adding a new log to the log train.

8. An apparatus for heating elongated metal logs according to claim 7 wherein said insert log and said pusher means have releasable interengaging means to pull said insert log means back from said furnace entrance opening with said pusher means for removing said insert log means from said log train.

9. An apparatus for heating elongated metal logs according to claim 8 wherein said interengaging means comprises an inverted U-shaped member having a slotted leg on said pusher means and a headed pin extending axially from an end of said insert log means, said pin being received within said slotted leg and a head of said headed pin being received within the legs of said inverted U-shaped member.

10. An apparatus for heating elongated metal logs according to claim 9 wherein said selective positioning means comprises means for mounting said insert log means for selective movement between a position axially adjacent said conveyor means and a position axially aligned with said conveyor means.

11. An apparatus for heating elongated metal logs according to claim 10 wherein said insert log mounting means is positioned at an end of said pusher table distal from said entrance opening of said furnace.

12. An apparatus for heating elongated metal logs according to claim 11 and further comprising a shear press positioned a spaced distance from the exit opening of said furnace and aligned therewith for cutting billets of a given length from the leading log in said log train; and said insert log means has a length at least equal to said spaced distance between the exit opening of the furnace and the shear press and the given length of said billets.

13. An apparatus for heating elongated metal logs according to claim 12 and further comprising a second pusher means mounted adjacent the shear press for pushing said log train toward said pusher table to return said leading log to said furnace after cutting a billet therefrom.

14. An apparatus for heating elongated metal logs according to claim 13 wherein said insert log has a diameter substantially equal to the diameter of said metal logs.

15. An apparatus for heating elongated metal logs according to claim 8 wherein said selectively positioning means comprises means for mounting said insert log means for selected movement between a position axially adjacent said conveyor means and a position axially aligned with said conveyor means.

16. An apparatus for heating elongated metal logs according to claim 15 and further comprising a shear press positioned a spaced distance from the exit opening of said furnace and aligned therewith for cutting billets of a given length; and said insert log means has a length at least equal to said spaced distance and the given length of said billet.

17. An apparatus for heating elongated metal logs according to claim 16 and further comprising a second pusher means for pushing said leading log and said log train toward said pusher table to return said leading log to said furnace after cutting a billet therefrom.

18. An apparatus for heating elongated metal logs according to claim 6 wherein said selectively positioning means comprises means for mounting said insert log means for selective movement between a position axially adjacent said conveyor means and a position axially aligned with said conveyor means.

19. An apparatus for heating elongated metal logs according to claim 6 and further comprising a shear press positioned a spaced distance from the exit opening of said furnace and aligned therewith for cutting billets of a given length from said leading log; and said insert log means has a length at least equal to said spaced distance and the length of said billets.

20. An apparatus for heating elongated metal logs according to claim 6 wherein said insert log has a diameter substantially equal to the diameter of said metal logs.

21. In an apparatus for feeding elongated metal logs of a given length to a furnace having an elongated heating chamber with an entrance opening and an exit opening at opposite ends thereof, said apparatus comprising:

a pusher table adapted to be mounted adjacent the entrance opening of said furnace chamber;

conveyor means extending along said pusher table for registry with the entrance opening of said furnace chamber and adapted to receive logs from a log dispenser adjacent said conveyor means; and pusher means mounted for movement along said conveyor means between opposite ends of said pusher table to push a lagging log on said conveyor means in a train of said logs into said entrance opening of said furnace chamber;

the improvement which comprises:

insert log means having a length substantially less than the given length of said logs and means for selectively positioning said insert log means on said conveyor means between said pusher means and said lagging log on said conveyor means to increase the effective length between the pusher means and a lagging end of said lagging log on said conveyor means prior to adding another log to said conveyor means.

22. An apparatus for feeding elongated metal logs according to claim 21 and further comprising means for selectively removing said insert log means from said conveyor before a new log is added to said log train.

23. An apparatus for feeding elongated metal logs according to claim 22 wherein said insert log and pusher means have releasable interengaging means to pull said insert log back from said furnace opening with said pusher means for removing said insert log from said conveyor means.

24. An apparatus for feeding elongated metal logs according to claim 23 wherein said selectively positioning means comprises means for mounting said insert log means for selective movement between a position axially adjacent said conveyor means and a position axially aligned with said conveyor means.

25. An apparatus for feeding elongated metal logs according to claim 24 wherein said insert log has a diameter substantially equal to a diameter of said metal logs.

* * * * *